United States Patent [19]

Fitch

[11] 3,948,177

[45] Apr. 6, 1976

[54] SELF-DISARMING EXPLOSIVE CARTRIDGES

[75] Inventor: Homer Lycurgus Fitch, Woodstock, N.Y.

[73] Assignee: Hercules Incorporated, Wilmington, Del.

[22] Filed: July 12, 1974

[21] Appl. No.: 488,107

[52] U.S. Cl. ..... 102/24 R; 181/116

[51] Int. Cl.[2] ..... F42B 3/10

[58] Field of Search ..... 102/24 R; 181/116

[56] References Cited

UNITED STATES PATENTS

| | | | |
|---|---|---|---|
| 3,348,483 | 10/1967 | Sorg, Jr. | 102/24 |
| 3,358,600 | 12/1967 | Griffith et al. | 102/24 |
| 3,431,848 | 3/1969 | Foster | 102/24 |
| 3,451,341 | 6/1969 | Dittmann | 102/24 |
| 3,463,085 | 8/1969 | Andrew | 102/24 |
| 3,509,820 | 5/1970 | Fitch et al. | 102/24 |

*Primary Examiner*—Verlin R. Pendegrass

[57] ABSTRACT

An explosive cartridge for underwater shooting which is self-disarming in the event of underwater misfire, which includes a closed shell with main explosive charge therein, and a conduit as a primer well, extending closed end first into the shell for support of an impact-responsive primer in detonating relationship with the main explosive charge. The conduit is supported intermediate its ends in a wall of the shell in watertight relationship therewith, and hence the open end of the conduit is outside, and spaced from, the shell interior. In response to force of impact initiation applied to the primer when supported in the conduit, the conduit member is further driven into the shell sufficiently to break its watertight relationship with the shell wall, the broken seal thus providing a path for ingress and egress of water for disarming the cartridge in the event of a misfire.

Also provided is the above cartridge with impact-responsive primer emplaced in the conduit well member to provide a complete cartridge assembly ready for firing.

9 Claims, 10 Drawing Figures

SELF-DISARMING EXPLOSIVE CARTRIDGES

This invention relates to explosive cartridges for underwater shooting, particularly for offshore seismic exploration, which are self-disarming in the event of an underwater misfire, thereby eliminating safety hazards involved when cartridges having failed to fire and thus remaining live, are ultimately washed ashore.

In underwater shooting of explosives, often during offshore seismic exploration, there are occasional misfires, i.e., a failure of the charge to shoot due to malfunction, so that the charge remains "live", uncontrolled, and substantially irretrievable. In many such instances, the unfired live cartridges are washed ashore and thus present serious safety hazards to persons and property in the adjacent shore areas. For these reasons, governing authorities often deem it necessary to halt such offshore operations absent assurance that the misfired explosives will not present those safety hazards normally encountered.

This invention is concerned with explosive cartridges for underwater firing and with the elimination of safety hazards in adjacent land areas in the event of misfire. Explosive cartridges, and assemblies, for underwater seismic exploration are disclosed in U.S. Pat. Nos. 3,509,959 and 3,509,820, and elsewhere, the former patent also disclosing associated self-disarming means.

In accordance with the invention, an explosive cartridge for underwater shooting and self-disarming in the event of an underwater misfire is provided which comprises:

a closed shell, and a main explosive charge therein;

a conduit having an open end and a closed end and extending closed end first into said shell as a primer well for support of an impact-responsive primer in detonating relationship with said explosive charge;

said conduit having its open end outside said shell and supported intermediate its ends in a wall of said shell in watertight relationship therewith, and having its closed end spaced from the opposite shell wall; and said conduit being yieldably movable from said watertight relationship toward said opposite shell wall in response to force of impact initiation applied to said primer toward said opposite wall when said primer is supported in said conduit in said detonating relationship.

Generally, a plastic adhesive moisture barrier material is disposed in closing watertight sealed relationship with the entire interface formed by the conduit and the shell wall supporting same.

In preferred practice, the conduit, also referred to herein as the primer well, is outwardly flanged at its open end, and an impact-responsive component of the primer for the finished assembly is seated on the outwardly flanged conduit end. In that embodiment, the force of impact initiation is directed onto the primer component in a direction substantially along the length of the conduit to thereby direct the impact force against the open end of the conduit to move it from its watertight position toward the opposite end of the shell, the broken water seal thus providing a path for ingress and egress of water for disarming in the event of failure of the shot.

Although any suitable impact-responsive primer can be supported in the primer well to form a finished cartridge assembly ready for firing, the now preferred primer is percussion initiatable and is described in the above-referred-to U.S. Pat. Nos. 3,509,959 and 3,509,820. Another impact-responsive primer is that electrically initiated upon impact and is disclosed and claimed in the copending application of R. R. Larson, Ser. No. 14,321, filed Feb. 26, 1970. In each instance, the primer is a component of an underwater seismic charge assembly which is electrically, or nonelectrically, fired upon impact with a pin-type element after the assembly is delivered under water pressure from above the water surface into the impact initiation system; and, in response to force of the impact, thereafter ejected during a predetermined delay period to an external point for firing.

The invention is further illustrated with reference to the drawings, all in cross section (except FIG. 3), of which FIG. 1 illustrates a shell component of an explosive cartridge of the invention, loaded through an open end with a main explosive charge, and to be subsequently closed with end wall and associated primer well structure for self-disarming under water;

FIGS. 1A and 1B, respectively, illustrate a closure member and primer well structure to be associated therewith as the self-disarming closure for the shell component of FIG. 1;

Figure 1:
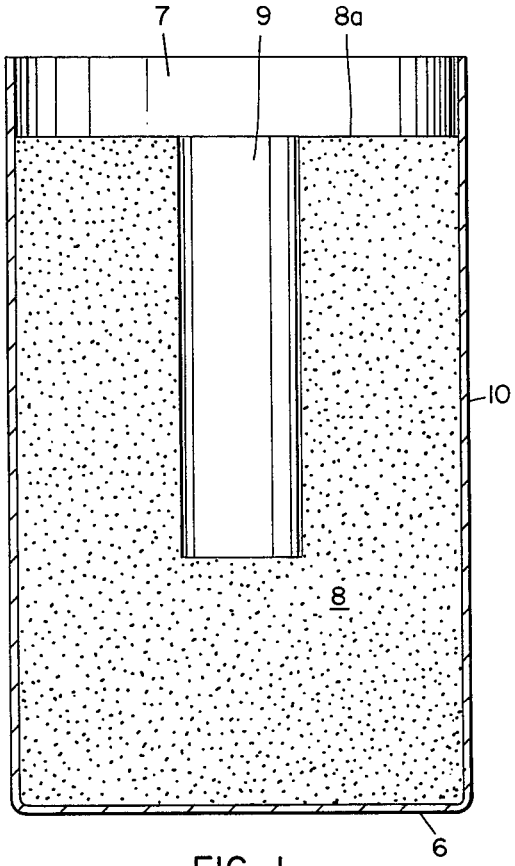
FIGS. 1C–1F illustrate a sequence of steps for assembling the closure and primer well components of FIGS. 1–1B to form the self-disarming closure member for the shell component.
Figure 1A:
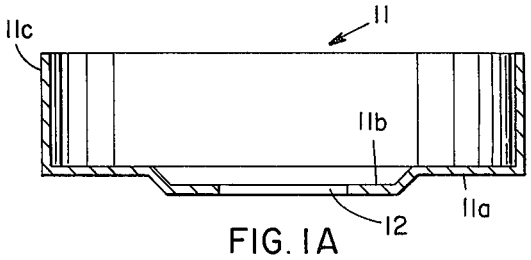
Figure 1B:
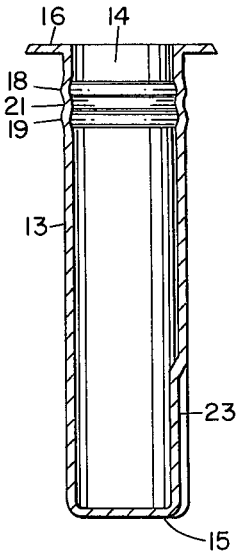

Referring to FIGS. 1, 1A and 1B, elongated shell 10, generally cylindrical, is closed at bottom end 6, open at top end 7 and contains main explosive charge 8, having perforation 9 extending from the upper charge surface 8*a*. Perforation 9 is a substantially coaxially extending cavity formed during conventional auger-type packing of shell 10 with explosive charge 8, and is dimensioned, by selection of a corresponding auger size, for accepting conduit 13 as a primer well. Shell 10 is loaded through open end 7 with main explosive charge 8 to a level short of top end 7, to provide space for receiving end closure member 11.

Closure member 11, to be positioned in the open end 7 of shell 10 in closing relationship therewith, includes end wall 11*a* for shell 10 and a central opening 12 extending through end wall 11*a* for receiving conduit 13 as a primer well in alignment with perforation 9.

Closure member 11 includes side wall 11*c* extending upwardly about its entire periphery for support of end closure 11 in shell 10, and central opening 12 extends through end wall 11*a* for receiving primer well 13 for support of an impact-responsive primer in detonating relationship with main explosive charge 8. A recess 11*b* in closure 11, encompasses central opening 12 for further support of a now-preferred impact-sensitive primer further described herein.

Conduit member 13 is open at its upper end 14 and closed at its bottom end 15, and has a laterally and outwardly extending flange 16 circumferentially disposed at open end 14. Flange 16 is generally integral with conduit 13.

Figure 1C:
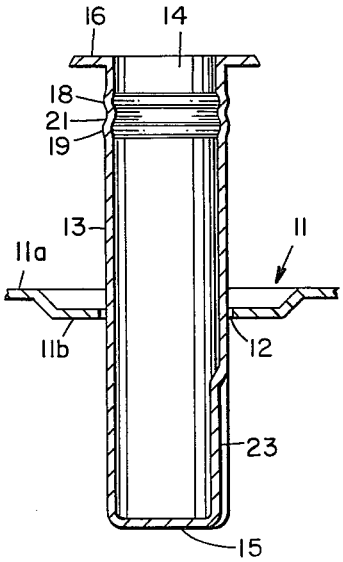
Figure 1D:
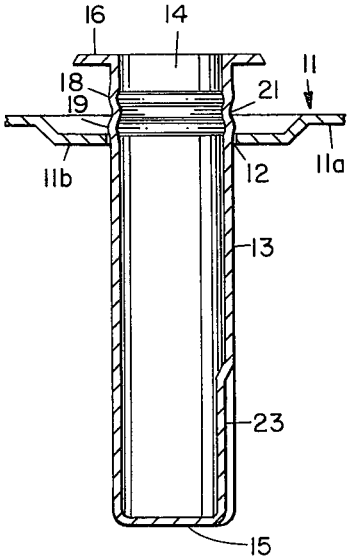
Figure 1E:
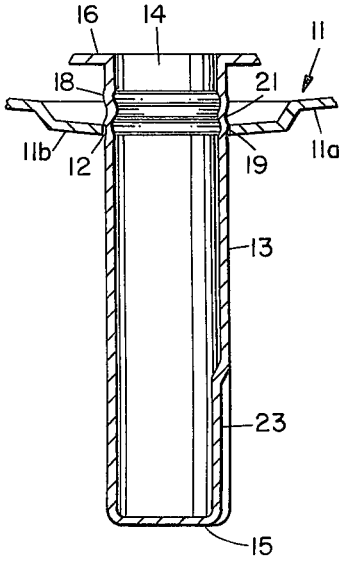

The external side wall of conduit 13 is deformed circumferentially in close proximity to open end 14 to form closely spaced apart and parallel ridges, or beads, 18 and 19 with formation of intermediate circumferential groove 21. As further illustrated with reference to FIGS. 1C–1D, the cross sectional dimension of conduit 13 is sufficiently less than that of central opening 12 to enable conduit 13 to be freely inserted through opening 12, closed end 15 first, as shown in FIG. 1C; however, the cross sectional dimensions of beads 18 and 19, which are generally the same, are each greater than that of opening 12 so that conduit 13 can be freely inserted through opening 12 only to the extent of seating bead 19 on the external surface of end wall 11*a* as shown in FIG. 1D. As shown in FIG. 1E, end wall 11*a* or bead 19 ,or both, as desired, are of suitable gauge to yield to force against the upper end 14 of conduit 13 sufficiently to permit passage of bead 19 through opening 12 but to then permit either end wall 11*a* or bead 19, or both, to spring or snap back into original position to cause end wall 11*a* to become locked in intermediate groove 21 in support of conduit 13, as shown in FIG. 1F.

A suitable plastic adhesive moisture barrier material 22 is then applied on the underside of end wall 11*a* in contact with the end wall 11*a* and conduit 13 surfaces adjacent the end wall 11*a*/conduit 13 interface in closing watertight relationship with the interface about the entire periphery of conduit 13.

Figure 2:
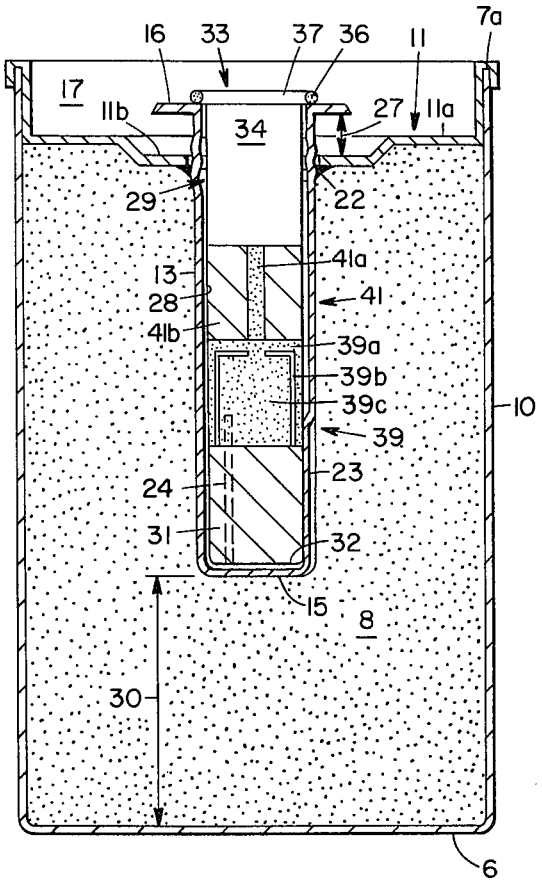
FIG. 2 illustrates an explosive cartridge assembly of the invention, ready for firing, including a shell and a main explosive charge component of FIG. 1 with closure means formed in accordance with the sequence of FIGS. 1C–1E, further illustrated with reference to FIG. 1F, and containing an impact-responsive primer for the main explosive charge.
Figure 4:
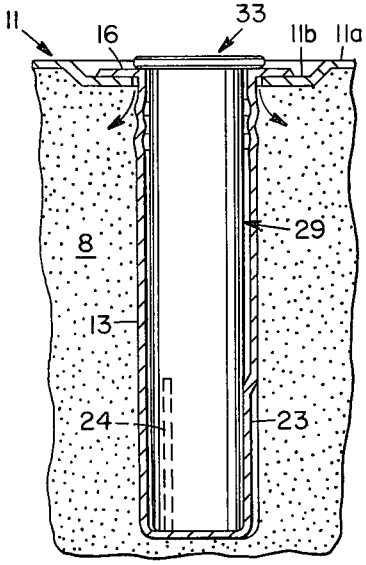
FIG. 4 illustrates the path of water ingress and egress providing for self-disarming of the explosive cartridge in the event of failure of an underwater shot. In the drawings, like numbers indicate like parts.

Suitable indentation means for supporting the primer in conduit 13 are advantageously utilized such as three equispaced longitudinally extending indents in the lower portion of conduit 13 of which indent 23 is shown in FIG. 1E and indents 23 and 24 are shown in FIGS. 2 and 4.

Figure 1F:
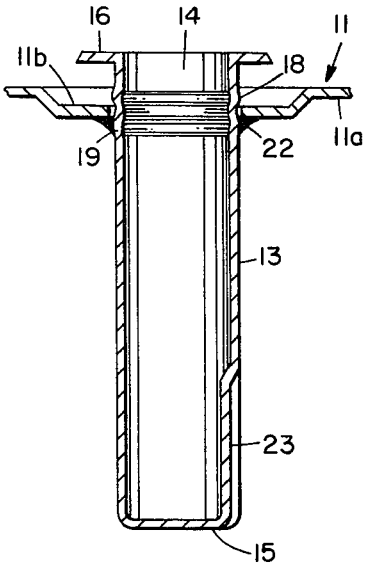

The end closure 11/primer well 13 assembly of FIG. 1F is then inserted into the open end 7 of shell 10 in closing relationship therewith. Thus, conduit 13 is inserted into perforation 9 substantially filling same, and end wall 11*a* is positioned on, or in close proximity to, the top surface 8*a* of main explosive charge 8. Side wall 11*c* of closure 11 is in close proximity to the inner surfaces of the upper end of the side wall of shell 10, i.e., above main explosive charge 8, and is of sufficient length to be crimp-rolled at its upper end on to the top end 7*a* of shell 10. The crimp-roll of end closure-primer well structure of FIG. 1F on to shell 10 is further illustrated with reference to FIG. 2.

Referring to FIG. 2, shell 10 contains main explosive charge 8, and primer well 13 is supported intermediate its open and closed ends in top end wall 11*a* by lock, bead and seal means illustrated with reference to FIGS. 1C–F with open end 14 outside shell 10 and closed end 15 spaced from opposite, or bottom, wall end 6 of shell 10. The vertical distance 27 between that portion of the top surface of wall 11*a* engaged with intermediate groove 21, and flange 16 of conduit 13, and the vertical distance 30 from the bottom end 15 of primer well 13 to the opposite wall 6 of shell 10 are correlated so as to permit the requisite travel of primer well 13 toward shell end 6 for self-disarming. Generally, the vertical distance 30 is at least as great as the vertical distance 27.

A now preferred percussion-initiatable primer 29 is disposed in conduit 13 for percussion initiation to in turn cause detonation of the main explosive charge 8. Elongated shell 28 of primer 29 contains a high explosive base charge 31 such as PETN, Tetryl, RDX, or the like, adjacent closed end 32 of shell 28. Wall, or cap, closure 33 is disposed in any suitable manner on, and across, the top and open end 34 of shell 29 in closing relationship therewith. Ignition, or primer charge 36, is supported in confinement in any suitable manner on the inner wall of closure 33, such as in a partially closed cavity 37 about the outer periphery of cap closure 33.

Confined ignition charge 36 is a suitable ignition composition which ignites to produce a flame in response to compression resulting from force of percussion applied to the outer surface of closure 33. Exemplary ignition charge 36 compositions are potassium perchlorate, lead styphnate, antimony sulfide, and mixtures of such materials, as are well known in the munitions art. Primer 39 is any suitable primer superposed on base charge 31; and delay 41, generally of the core type, is superposed on primer 39. Primer 39 is detonatable in response to heat and flame emitted from combustion of cored delay fuse 41*a* of delay 41 in lead tube 41*b*, fuse 41*a* in turn being ignitable in response to percussion ignition of ignition charge 36 and spaced in ignition relationship therewith. Base explosive charge 31 is detonatable in response to detonation of primer 39 and is disposed in detonating relationship therewith.

In preferred practice, primer 39 comprises a diazodinitrophenol wafer 39*a* pressed above and superposed on elongated capsule 39*b* which extends within and substantially coaxially with shell 28 in near closing relationship therewith. Capsule 39*b*, open at each end, is superposed on base charge 31 and contains a second diazodinotrophenol charge 39*c* of density lower than that of the wafer charge. The wafer charge 39*a* of diazodinitrophenol is of sufficiently high density to be ignitable in response to contact with the flame from ignition of delay fuse 41*a*, and the diazodinitrophenol charge 39*c* within the capsule is of sufficiently low density to be detonatable in response to heat developed by ignition of the diazo wafer charge 39*a* to thereby in turn cause detonation of the base charge 31. In other embodiments, primer 39 can be a single charge, such as lead azide, mercury fulmanate, and the like.

End closure 33 containing percussion initiatable charge 36, i.e., the impact-responsive component of primer 29, is in preferred practice a rim-fired or center-fired empty primed rifle cartridge casing as disclosed in the above referred to patents, see particularly FIGS. 1A and 1B of the drawings of the cited U.S. Pat. No. 3,509,820.

As illustrated with reference to FIG. 2, when conduit primer well 13 is emplaced in shell 10 in operable position, and also as illustrated with reference to FIGS. 1–1F, groove 21 is engaged with that portion of shell wall 11*a* forming passageway 12 and the adhesive moisture barrier is in place as illustrated with reference to FIG. 1F. That portion of conduit primer well member 13 extending the vertical distance 27 from flange 16 above the shell wall closure 12, i.e., outside the cartridge shell, is generally within the confines of recess 17.

Conduit member 13 is yieldably movable downwardly into main charge 8 substantially axially toward the opposite shell end 6, when sufficient force is applied to the open end of conduit 13, to overcome the biasing effect of wall 11*a* to retain conduit 13 in locked relationship with groove 21. When percussion firing charge 36, there is sufficient force of impact initiation transferred to the open end of conduit 13 that the biasing effect of wall 11*a* is overcome so as to drive conduit assembly 13 further axially into charge 8 until flange 16 is seated on the external, or top, side of closure wall 11*a* and the watertight seal formed by barrier material 22 is broken, as further illustrated with reference to FIG. 4. Hence, conduit 13 is moved from its watertight relationship with wall 11*a* to provide a path for water ingress and egress at the interface between the end closure wall 11, and the bottom surface of flange 16, and conduit 13, as shown by the arrows. This water ingress/egress passageway provides for self-disarming after a misfire, by ingress of sufficient water to dissolve the nitrocarbonitrate charge and permit the resulting dissolved material to flow from the assembly along the path of the broken seal, or in all events to cause the explosive to become insensitive and harmless by action of the incoming water.

Figure 3:
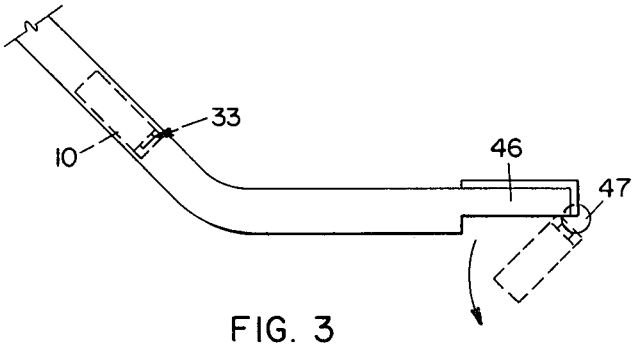
FIG. 3 illustrates a system adapted for underwater firing of an explosive assembly of FIG. 2.

As illustrated with reference to FIG. 3, one suitable means for underwater emplacement of the cartridge assembly of the invention is that illustrated in U.S. Pat. No. 3,509,820, particularly with reference to FIG. 5A of that patent, including delivery of the impact-responsive explosive cartridge assembly under force of water pressure into the upstream end of a firing gun 46 into contact of percussion-sensitive end 33 with a wheel-type pin assembly 47 supported in the path of forward travel of the charge assembly at the forward end of the firing gun. In this manner, the force of impact for the percussion initiation, i.e., upon collision of the percussion-sensitive end 33 of the primer with wheel member 47 causes ignition of the percussion charge which, in turn, ignites the delay charge 41*a* with subsequent detonation of the primer and base charges, the charge being pivotally moved, during the delay period about wheel 47 for detonation outside the system as indicated by the arrow of FIG. 3.

In response to the force of impact initiation at the time of collision of the explosive charge assembly with the firing wheel 47 of the firing device 46, the biasing effect of wall member 11 to retain its locked position in groove 21 with conduit member 13 is overcome. Wall 11*a* again yields downwardly to accept passage of bead 18 through opening 12 as above illustrated with reference to ridge 19 and FIG. 1E, and to then permit further travel of conduit 13 into shell 10 with concomitant breakage of moisture barrier seal 22 with seating of flange 16 on wall 11 as illustrated with reference to FIG. 4. The impact-responsive charge is then percussion initiated and pivotally thrown from the firing device into the adjacent water body for the detonation. During the short delay period the amount of water flowing along the path of the broken seal cannot impair success of the shot. However, in the event of a misfire, there is sufficient time for the water to flow into and from the interior of the cartridge shell through the broken seal for removal, or desensitization, of the main charge to render it harmless so that if washed ashore the misfired cartridge is no longer "live".

By way of illustration, the water ingress and egress passageway is generally sufficient to permit desensitization and/or removal of the charge within a period of say from about 2 to 16 hours, when the quantity of explosive charge is up to about 10 pounds under a hydrostatic head of about 50 feet.

Exemplary plastic adhesive moisture barrier materials for formation of the water barrier seal 22 of the drawings are hot melts such as pitch, low molecular weight polyethylene, oxidized polyethylene, ethylene-vinyl acetate copolymers, hydrocarbon resins, thermoplastic elastomers such as block copolymers of styrene and polybutadiene, and paraffin or microcrystalline wax often blended with a strengthening agent such as polyethylene, amorphous polypropylene, ethylene-vinyl acetate copolymers, or ethyl cellulose; emulsions such as neoprene or buna N rubber latices, often filled; solvent applied adhesives such as resin-rubber contact adhesives; and organosols such as poly (vinyl chloride), plastisols, and polypropylene powder in hydrocarbon suspension. The water barrier material can be applied to close the end wall 11*a*/conduit 13 interface in any known suitable manner dictated by the characteristics of the particular barrier material, often by extrusion or spatula-type application.

In preferred practice, the cartridge shell 10 is a metal in which the gauge of the wall end closure 11*a* is in order of from about 0.010 to 0.020 inches, and the conduit primer well member is formed from a metal having a gauge in about the same range. Often, the end wall 11*a* and primer wall member are fabricated from the same metal, as, for example, steel having a gauge in order of about 0.015 inches.

Although any suitable explosive can be utilized as the main explosive charge in the explosive cartridge of the invention, the explosive charge is generally cap-insensitive, often of the nitrocarbonitrate type and having a weight in the order of 10 pounds or less, further exemplary of which are those having a weight in the order of about ⅛ to 3 pounds as disclosed in the above referred to U.S. Pat. Nos. 3,509,959 and 3,509,820.

Recess 17, formed by extension of the wall of shell 10, as illustrated in the drawings, is advantageously utilized to encompass the terminated upper end of the primer well and the percussion-sensitive primer end 33 seated thereon as illustrated with reference to FIG. 2. In that form, the cartridge assembly protects the percussion-sensitive portion of the primer from accidental percussion firing upon being dropped, or other mishandling prior to loading for firing.

Recess 11*b*, in end wall 11*a*, see for example FIG. 1A, advantageously serves to supportably encompass both the flanged end 16 of conduit 13 and the percussion end 33 of the primer after the impact initiation, so as to supplement the structural integrity of the percussion-sensitive end of the primer to further assure detonation of the primer for a successful shot.

It will be evident to those skilled in the art, various modifications can be made or followed, in light of the foregoing disclosure and discussion without departing from the spirit or scope of the disclosure or from the scope of the claims.

What I claim and desire to protect by Letters Patent is:

1. An explosive cartridge for underwater firing which is self-disarming in the event of an underwater misfire, comprising:

a closed shell, and a main explosive charge therein;

a conduit having an open end and a closed end and extending closed end first into said shell as a primer well for support of a percussion impact-responsive primer in detonating relationship with said explosive charge;

said conduit supported intermediate its ends in a wall of said shell in watertight relationship therewith so as to have its open end outside said shell and spaced from said shell wall and its closed end spaced from the opposite shell wall; and said conduit being yieldably movable from said watertight relationship toward said opposite shell wall in response to force of percussion impact initiation applied to said primer in a direction toward said opposite shell wall when said primer is supported in said conduit in said detonating relationship.

2. In an explosive cartridge of claim 1, a plastic adhesive water-barrier material disposed in closing watertight sealed relationship with the entire interface formed by said conduit and the shell wall supporting same.

3. In an explosive cartridge of claim 2, said plastic barrier material disposed inside said shell and in sealing contact with conduit and shell wall surfaces adjacent said interface.

4. In an explosive cartridge of claim 3, said open end of said conduit forming an outwardly extending circumferential flange for seating an impact responsive component of said primer thereon.

5. In an explosive cartridge of claim 4, said conduit having on its external surface a pair of spaced apart outwardly extending circumferential ridge members in planes substantially parallel and coaxial with said conduit, and said conduit extending through an opening in said supporting wall and supported therein in locked relationship along the resulting circumferential groove intermediate said pair of ridges.

6. In an explosive cartridge of claim 5, said conduit and each said ridge having a circular cross section; said supporting wall containing said opening in circular cross section, and each said ridge member having a diameter greater than that of said opening; and at least one of said supporting wall and said ridges being sufficiently yieldable to permit axial movement through said opening of each said conduit portion containing one of said ridges to thereby provide for said locked support and to permit subsequent axial travel of said conduit, with breakage of said sealed relationship, toward said opposite shell end.

7. An explosive cartridge assembly comprising an explosive cartridge of claim 1, and a percussion-initiatable primer for said main explosive charge supported in said conduit in detonating relationship with said main explosive charge; and the percussion-responsive ignition component of said primer seated on the open end of said conduit.

8. In an explosive cartridge assembly of claim 7, a nitrocarbonitrate as said main explosive charge.

9. In an explosive cartridge assembly of claim 8, said open end of said conduit forming an outwardly extending circumferential flange, and said primer containing an empty primed rifle cartridge case at one end thereof as said percussion-responsive ignition component; and said cartridge case seated along a peripheral portion thereof on said flange.

* * * * *